US009530549B2

(12) United States Patent
Kuhnert et al.

(10) Patent No.: US 9,530,549 B2
(45) Date of Patent: Dec. 27, 2016

(54) SUPERCONDUCTING COIL DEVICE WITH SWITCHABLE CONDUCTOR SECTION AND METHOD FOR SWITCHING

(71) Applicant: SIEMENS AKTIENGESELLSCHAFT, München (DE)

(72) Inventors: Anne Kuhnert, Fuerth (DE); Peter Kummeth, Herzogenaurach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/837,529

(22) Filed: Aug. 27, 2015

(65) Prior Publication Data

US 2016/0064127 A1 Mar. 3, 2016

(30) Foreign Application Priority Data

Aug. 29, 2014 (DE) ..... 10 2014 217 250

(51) Int. Cl.

| | |
|---|---|
| ***H01F 1/00*** | (2006.01) |
| ***H01F 6/06*** | (2006.01) |
| ***H01F 7/02*** | (2006.01) |
| *H01F 41/04* | (2006.01) |

(52) U.S. Cl.

CPC ..... *H01F 6/06* (2013.01); *H01F 7/0205* (2013.01); *H01F 41/048* (2013.01)

(58) Field of Classification Search

CPC ..... H01F 41/048; H01F 6/008
USPC ..... 335/216
See application file for complete search history.

(56) References Cited

U.S. PATENT DOCUMENTS 3,324,436 A * 6/1967 Mueller ..... H01L 39/20 257/E39.012
5,130,686 A * 7/1992 Leupold ..... H01F 6/00 335/216
5,343,182 A * 8/1994 Ohta ..... G01R 33/3875 324/319
5,475,560 A * 12/1995 Onishi ..... H02H 9/023 361/141
5,757,257 A * 5/1998 Doi ..... H01L 39/20 324/318
6,043,731 A * 3/2000 McDougall ..... H01L 39/20 338/32 S (Continued)

FOREIGN PATENT DOCUMENTS

DE 3739412 A1 6/1989
DE 10 2010 042 598 A1 4/2012

(Continued)

OTHER PUBLICATIONS

German Office Action issued Apr. 21, 2015 in corresponding German patent application No. 10 2014 217 250.0.

*Primary Examiner* — Alexander Talpalatski
(74) *Attorney, Agent, or Firm* — Slayden Grubert Beard PLLC

(57) ABSTRACT

In a coil device with at least one electrical coil winding with superconducting conductor material, the coil winding is part of a self-contained circuit for formation of a continuous current. The closed circuit has a switchable conductor section which can be switched between a superconducting state and a normally conducting state by a magnetic device.

20 Claims, 2 Drawing Sheets

(56) References Cited

U.S. PATENT DOCUMENTS

| | | | | |
|---|---|---|---|---|
| 6,236,545 | B1 * | 5/2001 | McDougall | H02H 9/023 361/141 |
| 2008/0207458 | A1 * | 8/2008 | Hong | H01F 6/06 505/238 |
| 2010/0001821 | A1 * | 1/2010 | Diederichs | H01F 6/008 335/216 |
| 2013/0096008 | A1 * | 4/2013 | Bright | H01L 39/20 505/211 |

FOREIGN PATENT DOCUMENTS

| | | |
|---|---|---|
| DE | 10 2014 217 250.0 | 8/2014 |
| JP | 4-176174 | 6/1992 |

* cited by examiner

SUPERCONDUCTING COIL DEVICE WITH SWITCHABLE CONDUCTOR SECTION AND METHOD FOR SWITCHING

CROSS REFERENCE TO RELATED APPLICATIONS

This application is based on and hereby claims priority to German Application No. 10 2014 217 250.0 filed on Aug. 29, 2014, the contents of which are hereby incorporated by reference.

BACKGROUND

Superconducting coils are used for the generation of strong, homogenous and temporally stable magnetic fields which are operated in continuous current mode. Homogenous magnetic fields with magnetic flux densities between 0.2 T and 20 T are, for example, required for Nuclear Magnetic Resonance spectroscopy (NMR spectroscopy) and for magnetic resonance imaging. These magnets are typically charged via an external circuit and then separated from the external power source as an almost loss-free current flow takes place via the superconducting coil in the resulting continuous current mode. The resulting strong magnetic field is particularly stable temporally as it is not influenced by the noise contributions of an external circuit.

When using known superconducting coil windings, one or more superconducting wires are wound on supporting bodies, various wire sections being brought into contact with each other via wire connections with the smallest possible ohmic resistance or via superconducting connections. For known low-temperature superconductors such as NbTi and $Nb_3Sn$ with transition temperatures below 23 K, there are technologies for making superconducting contacts for the linking-up of wire sections and for the connection of windings with a so-called superconducting continuous power switch. The known superconducting continuous power switches are each part of the circuit of the coil and are put into a resistive conducting state for the supply of an external current by means of heating. After switching off the heating and cooling to the operating temperature, this part of the coil also becomes superconductive again.

High-temperature superconductors or High-$T_c$-Superconductors (HTS) are superconducting materials with a transition temperature of more than 25 K and in the case of some material classes, for example, cuprate superconductors, of more than 77 K, for which the operating temperature can be reached by cooling with other cryogenic materials as liquid helium. HTS materials are particularly attractive for the production of magnetic coils for NMR spectroscopy and magnetic resonance imaging as some materials have high upper critical magnetic fields of more than 20 T. As a result of the higher critical magnetic fields, in principle HTS materials are better suited to the generation of high magnetic fields of, for example, more than 3 T or even more than 10 T than low-temperature superconductors.

A problem with the production of HTS magnetic coils is the lack of suitable technologies for the production of superconducting HTS connections, in particular, for second-generation HTS, so-called 2G HTS. 2G HTS wires are typically available in the form of flat coated conductors. If ohmic contacts are inserted between the superconducting coated conductors, the losses in the coil can no longer be ignored and the magnetic field generated declines markedly within a period of a few hours or days.

DE 10 2010 042 598 A1 specifies a superconducting MR magnet arrangement which has a superconducting coated conductor which is provided with a slit between the two ends in a longitudinal direction, the superconducting coated conductor thus forming a closed loop surrounding the slit. In the magnet arrangement the superconducting coated conductor is wound into at least one double coil comprising two coil sections which are twisted against each other in such a way that they generate a predetermined magnetic field course in a measurement volume. The subsequent introduction of superconducting connections is unnecessary for such a coated conductor with doubly connected topology. A superconducting continuous power switch can be formed in turn by a heatable local subsection of the conductor loop, this subsection being surrounded by two contacts for connection to an external feed current for feeding a current into the coil winding.

A disadvantage of such a known coil device is that the heatable area of the coated conductor constitutes a weak point at which the coated conductor is particularly susceptible to delamination and other damage. If, for example, damage occurs when fastening the heating, the entire coated conductor is destroyed thereby because no subsequent contacts can be introduced for repair due to the principle of the continuous slotted conductor loop. A further disadvantage is that for the heating additional current supplies are required for connection to a heating circuit, which must be routed from a warm external environment into the environment of the superconductor at a cryogenic temperature. As a result of these additional current supplies, additional paths for thermal losses are created, thus making the cooling of the superconducting coated conductor to its operating temperature more difficult. Additional disadvantages result from relatively slow switching behavior and the relatively long conductor areas required for thermal switching.

SUMMARY

The embodiments describe herein relate to a coil device with at least one electrical coil winding with superconducting conductor material, the coil winding being part of a self-contained circuit for the formation of a continuous current.

The embodiments described below are related to a coil device which avoids the aforementioned disadvantages. In particular, a robust coil device should be specified with which the coated conductor is exposed to a low risk of damage during production and operation. Furthermore, a simply constructed coil device which is easy to cool and which does not require any additional power supplies for connection of the switchable region to an external heating circuit should be constructed. A further task of the embodiments described below is to specify a switching method for the switching of a conductor section of a superconducting coil device.

The coil device according to the embodiments described herein include at least one electrical coil winding with superconducting conductor material, the coil winding being part of a self-contained circuit for the formation of a continuous current. The closed circuit has a switchable conductor section the conductor of which can be switched between a superconducting state and a normally conducting state by means of a magnetic device.

A major advantage of the coil device according to the embodiments described herein is that a heating device does not need to be attached to this conductor section for switching of the conductor section and current supplies for a heating current do not need to be introduced into the environment of the conductor section, which is at a cryogenic temperature. Instead a superconducting continuous power switch is provided by means of a magnetic device, by means of which a magnetic field can be generated in the region of the switchable conductor section, as a result of which switching between a normally conducting state and a superconducting state is enabled. The magnetic device can be expediently designed so that the magnetic field is variable at the site of the switchable conductor section. The strength of the magnetic field in the region of the switchable conductor section can be switched between at least two levels. By increasing the magnetic field, it is then possible to switch from the superconducting state to the normally conducting state, for example by exceeding the critical magnetic field. Vice versa, by reducing the magnetic field, switching from the normally conducting state to the superconducting state can be achieved.

Expediently the coil device has at least two contacts for connection of the coil winding to an external feed circuit which are arranged on both sides of the switchable conductor section. Via this feed circuit the coil can, for example, be charged by means of an external power source. By arranging the switchable conductor section between the contacts, after switching to the normally conducting state—by increasing the magnetic field—feeding of a charging current from the feed circuit to the coil winding is enabled. After this charging, the conductor section can be returned to the superconducting state by reducing the magnetic field so that the continuous current introduced when charging can then flow in the self-contained circuit of the coil device. The length of the switchable conductor section can generally be advantageously shorter than in the case of a conductor section which is brought into a normally conducting state by heating. As a result of this, the conductor section between the power contacts can generally be shorter in length, and the overall length of non-coiled conductor material required may be less. This makes a more compact embodiment of the coil device possible.

The method described herein serves to switch a conductor section of a coil device between a superconducting state and a normally conducting state, wherein the coil device includes at least one electrical coil winding with superconducting conductor material and wherein the coil winding is part of a self-contained circuit for the formation of a continuous current. The method is characterized by the increasing and/or reduction of a magnetic field generated by a magnetic device in the region of the conductor section. The advantages of the method arise analogous to the aforementioned advantages of the coil device. Advantageously, switching between the superconducting state and normally conducting state using the described method can generally take place more rapidly than by heating a switchable conductor section.

The described embodiments of the coil device and the switching method can be advantageously combined with each other.

The magnetic device may have at least one permanent magnet. Advantageously, in this way a magnetic field can be generated in the region of the switchable conductor section without additional electrical connections being required for this. Thus, there is also no need for additional electric lines and switching of the conductor section can take place easily. In particular, additional heat input into the cryogenic environment of the superconductor by means of additional electrical connections is advantageously avoided. The generation of a magnetic field by means of at least one permanent magnet is robust and fail-safe as no delicate electric components are required. Furthermore, no electrical power for the generation of the magnetic field need be provided.

The permanent magnet may advantageously include an alloy of neodymium, iron and/or boron. Alternatively, or in addition, the permanent magnet may include an alloy of samarium and/or cobalt. These and similar materials are particularly well suited to the formation of strong permanent magnets.

At least one permanent magnet can be arranged in a flexible manner relative to the switchable conductor section. As a result of this relative movement, an increase or reduction of the magnetic field at the site of the conductor section is easily enabled. In particular, with this embodiment for this increase and/or reduction—and thus for the switching of the conductor section—no electrical switching operations are required in the vicinity of the conductor section.

The coil device may have a vacuum container which surrounds the superconducting coil winding and at least part of the magnetic device. Expediently, besides the superconducting coil winding, the vacuum container may surround the entire electrical conductor of the self-contained circuit. Thermal insulation of the superconducting conductor material from a warm external environment can easily be achieved by means of such vacuum insulation. As a result, during the operation of the coil device the entire conductor of the closed circuit can more easily be kept at an operating temperature beneath the transition temperature of the superconductor and thus in a superconducting state. Expediently, the part of the magnetic device which generates the magnetic field at the site of the switchable conductor section and/or guides it to the site of the switchable conductor section is likewise arranged inside the vacuum container. Thus, at least the part of the magnetic device directly adjacent to the switchable region can advantageously be thermally insulated by means of the vacuum from the cryogenic superconductor and/or from the warmer environment. By this means, additional heat input to the region of the superconducting conductor material is advantageously restricted. For an embodiment with at least one permanent magnet, in particular this permanent magnet may be arranged inside the vacuum container to generate a magnetic field in close proximity to the switchable conductor region. To protect the superconductor from additional heat input, in addition the superconductor may be universally shielded from the radiant heat from the magnetic device and/or from additional components, for example, by means of wrapping in superinsulation film.

The coil device, in particular the switchable conductor section, may advantageously have a superconducting coated conductor. Particularly advantageously, the electrical conductor of the coil winding may also be designed as a superconducting coated conductor. In particular, the self-contained circuit may essentially include superconducting coated conductor material. The coated conductor may have a high-temperature superconducting layer, in particular a compound of the $REBa_2Cu_3O_x$ type, RE standing for a rare earth element or a mixture of such elements. Alternatively, the superconducting layer of the coated conductor may, for example, include magnesium diboride.

In the case of an embodiment with a superconducting coated conductor, the magnetic device may be designed vertically to the plane of the coated conductor in the region of the switchable conductor section for the formation of a magnetic field with a directional component. The generated magnetic field may display an angle of less than 45 degrees to the normal plane, in particular even less than 30 degrees, in an area of the switchable conductor section. Particularly advantageously, the magnetic field may be vertical or at least almost vertical to the coated conductor plane at least in a subsection of the switchable conductor section.

Such an embodiment with a high directional component of the magnetic field vertical to the coated conductor surface is particularly advantageous in combination with a coated conductor with a high-temperature superconducting layer of the $REBa_2Cu_3O_x$ type. Such a layer may have a crystalline structure of the Perowskit type, wherein its crystallographic c-axis may essentially be vertical to the layer plane or may at least have a high directional component vertical to the layer plane. In the case of orientation of the magnetic field with a high directional component parallel to the c-axis, a strong dependence of the superconducting properties on the strength of the magnetic field can be achieved.

The superconducting coated conductor may be a bifurcated coated conductor with doubly connected topology. The definition of the term "doubly connected" in geometric topology is here understood to mean that the coated conductor has the topology of a simple loop with a hole. Such a doubly connected coated conductor may be produced by slitting a singly connected coated conductor in a longitudinal direction resulting in two conductor branches which are connected at both ends of the original strip. By means of repeated slitting in a longitudinal direction, a doubly connected coated conductor with more than two conductor branches may also be formed and used accordingly. With this embodiment, a closed circuit with continuous superconducting material can easily be made available without subsequent insertion of contact points. The switchable conductor section may, for example, particularly advantageously be a section in the region of the unslit conductor end—if this switchable region extends to the start of the slit—or it may be a section of the slit coated conductor adjacent to this conductor end.

By means of magnetic switching of a subsection of the doubly connected conductor loop, a superconducting continuous power switch may be made available in a particularly simple manner, likewise without requiring subsequent contacts inside the closed circuit. Contacts for connection with an external feed circuit may be expediently attached to both sides of the switchable region. The attachment of a heating device and thermal loading during its operation may be avoided, however, and the typically relatively sensitive coated conductor material is spared further mechanically stressful process steps.

The contacts for connection to an external feed circuit are expediently arranged on both sides of the switchable region but must not be immediately adjacent to this. They may also be advantageously located on both unslit ends of the slit conductor. Large conductor areas for the contacts are available there. Furthermore, the power contacts there can be attached at a safe distance from the slit conductor with a smaller width.

The coil device may advantageously have a continuous superconducting conductor which extends over the entire closed circuit. With such a continuous superconducting conductor, the coil device can be operated particularly advantageously in continuous current mode without the current decaying significantly over the operating period. For this purpose, the entire ohmic resistance of the closed circuit may advantageously be no more than 5 nOhm, particularly advantageously no more than 0.05 nOhm. With the aforementioned topology with a slit doubly connected coated conductor, such a continuous superconducting circuit can be achieved particularly easily.

The switchable conductor section may advantageously adjoin a radially external region of the coil winding. This is particularly expedient if the switchable conductor section itself is not part of the coil winding. Alternatively, it may also be in a radially external region of the coil winding if the switchable conductor section itself is part of the coil winding. Generally, an arrangement of the switchable conductor section at least in the vicinity of radially external parts of the coil winding is advantageous in order to enable connection of the switchable conductor section to the conductor regions of the actual coil winding to be as short as possible and at the same time to ensure that access to the switchable conductor section is as free as possible. Such free geometric access to this switchable conductor section is important, for example, in order to specifically generate a magnetic field in the region of this conductor section from which the remaining part of the electrical conductor, in particular, remains shielded or unaffected in the region of the actual coil winding. The coil winding may, for example, be a cylindrical coil winding with any (i.e. including non-circular) surface area, with which the radially external regions are geometrically more accessible for connection to a continuous power switch than the radially internal regions.

The at least one permanent magnet of the magnetic device may be connected to a magnetically soft yoke for the guidance of the magnetic field to the switchable conductor section. With such an embodiment, the permanent magnet need not be arranged in immediate physical proximity to the switchable conductor section but the magnetic field may be guided from a more distant location to the switchable conductor section by the magnetically soft material of the yoke. This may, for example, be advantageous in keeping the permanent magnet at a higher temperature than the superconducting conductor material and nonetheless minimizing heat input from the permanent magnet to the superconducting material. By means of the magnetically soft yoke, the magnetic flow can be specifically guided to a particular region in which the switchable conductor section can be positioned. The field course may thus be concentrated in the region of the conductor section. The superconducting properties of this section may be cancelled or at least impaired hereby. By moving at least part of the magnetic device relative to this conductor section, the specific guidance of the magnetic field to the location of the conductor section may be prevented, resulting in switching back to the superconducting state.

With the aforementioned embodiment, the whole arrangement of the permanent magnet and the yoke relative to the switchable conductor section may, for example, be flexibly arranged. Alternatively, either the permanent magnet individually or at least part of the yoke individually may be flexibly arranged relative to the switchable conductor section so that the guidance of the magnetic flow can be altered depending on the position of parts of the magnetic device. Thus, a change in the magnetic field at the site of the switchable conductor section can be easily achieved by means of a mechanical movement, as a result of which switching between a superconducting state and a normally conducting state is possible.

The magnetically soft material of the yoke may advantageously contain iron and/or an iron alloy. The yoke may be formed of one or more massive bodies, or it may be formed of a stack of magnetically soft sheets. The magnetically soft material may advantageously have a relative permeability of at least 30.

The coil device may have a vacuum container which surrounds the superconducting coil winding and the magnetic device, wherein at least part of the magnetic device can be moved by a force exerted outside the vacuum container. The magnetic device may therefore be arranged by an externally exerted movement such that, for example, the magnetic field generated by a permanent magnet is guided to the switchable conductor section. For this purpose, for example, the at least one permanent magnet and/or one magnetically soft yoke or part of such a yoke may in turn be moved relative to the switchable conductor section. As a result of this externally exerted relative movement, altogether a magnetic field active at the site of the switchable conductor section may be increased and/or reduced to switch the conductor section between a superconducting and a normally conducting state.

The described movement initiated from an area outside the vacuum container may, for example, be transferred to the internal components with the aid of bellows in the external wall of the vacuum container. Alternatively, the movement may be transferred via a vacuum-tight piston rod through the external wall of the vacuum container to the inside.

The method for switching a conductor section may thus be designed such that switching occurs as a result of the movement of a permanent magnet relative to the conductor section. The advantages of this embodiment are analogous to the corresponding embodiment of the coil device. Alternatively, or in addition, switching may also take place by means of the movement of another part guiding the magnetic flow, for example a magnetically soft yoke.

In general, increasing the magnetic field in an initial step may lead to a reduction in the critical current density in the superconducting state of the conductor section, and in a subsequent step the feeding of a current from an external feed circuit may lead to the achievement of the normally conducting state of the conductor section. The strength of the applied magnetic field can therefore be measured in such a way that superconductivity is not yet fully suppressed by this magnetic field. When connecting an external power source of a feed circuit, the power then branches off first so that a portion flows through the superconducting coil winding and a further not inconsiderable portion flows through the switchable conductor section.

On the other hand, however, the magnetic field may nevertheless be so strong that the critical current density is so greatly reduced that when the portion of the feed current described flows, the superconductivity collapses as a result of exceeding this critical current density in a second step and during feeding a normally conducting state is achieved under the influence of the magnetic field. After termination of current feeding and after subsequent reduction of the magnetic field, in turn the superconducting state is achieved again for operation in continuous current mode. With this embodiment described, switching between the normally conducting and superconducting state therefore occurs as a result of a combination of the influence of the altered magnetic field and the current flowing in the switchable conductor section at the respective time.

Switching of the conductor section can be carried out at an operating temperature of the conductor section of between 15 K and 77 K (for example, with a conductor based on magnesium diboride), particularly advantageously between 50 K and 77 K (for example, with solid oxide high-temperature superconductors). This embodiment is particularly advantageous as at such relatively high operating temperatures switching can be achieved relatively easily by means of magnetic fields which are not overly strong. At lower temperatures on the other hand, stronger magnetic fields are necessary to bring about switching to a normally conducting state. The magnetic flow density generated by the magnetic device in the region of the switchable conductor section may generally be, for example, up to 3 T. When operating the coil device at higher temperatures, advantageously it may only be at values in the region of up to 2 T. The operating temperature for subsequent continuous operation of the coil device can advantageously be set lower than the operating temperature for the switching operation. Thus, for switching to the normally conducting state for feeding of the current, a higher temperature, for example between 50 K and 77 K, may be selected to facilitate switching by means of a magnetic field. For continuous operation, altogether the superconductor may then be cooled to a lower temperature.

BRIEF DESCRIPTION OF THE DRAWINGS

These and other objects and advantages will become more apparent and more readily appreciated from the following description of the various embodiments, taken in conjunction with the accompanying drawings of which.

DETAILED DESCRIPTION OF THE PREFERRED EMBODIMENT

Figure 1:
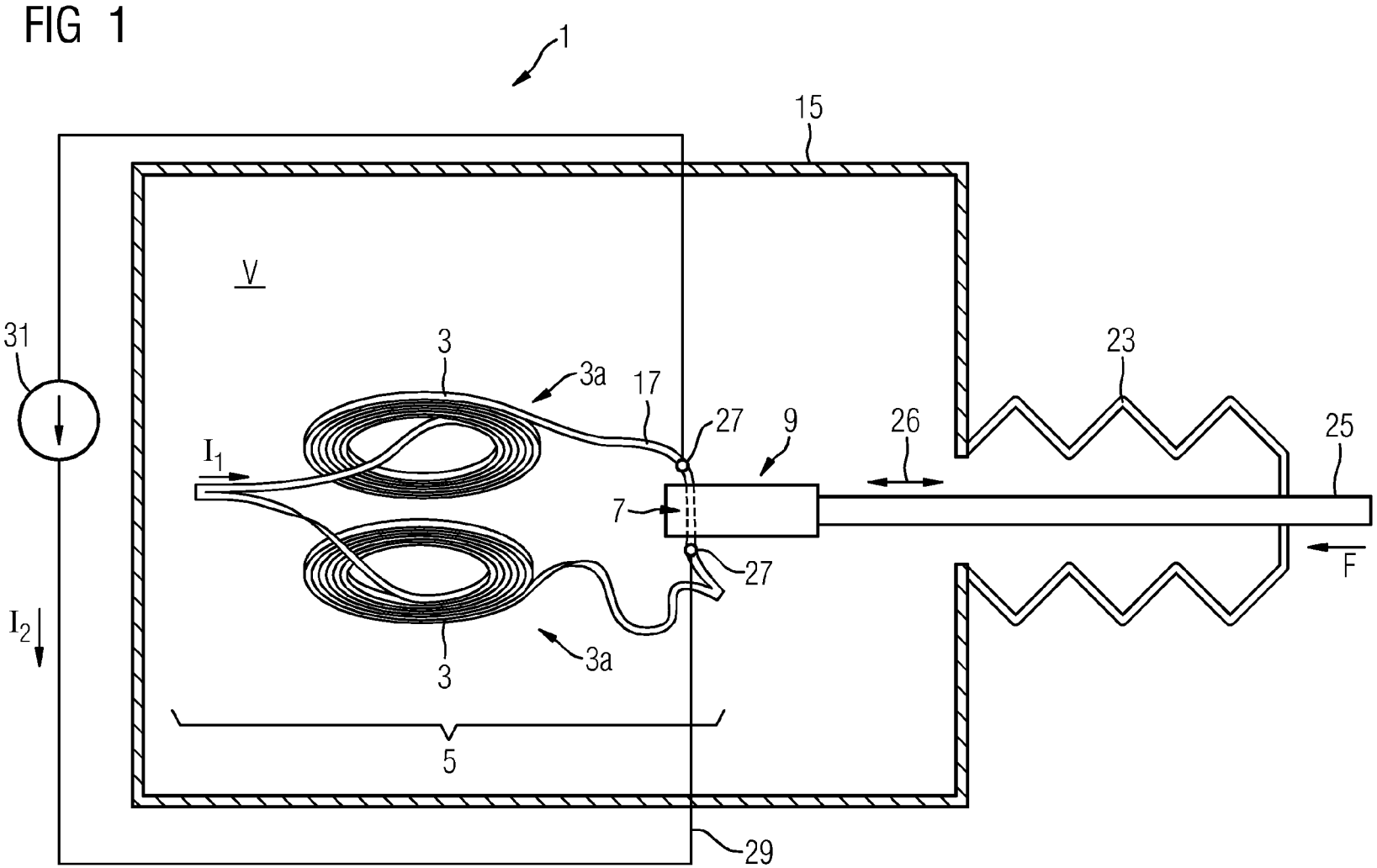
FIG. 1 is a longitudinal diagrammatic view of a coil device according to the exemplary embodiment.

Reference will now be made in detail to the various embodiments, examples of which are illustrated in the accompanying drawings, wherein like reference numerals refer to like elements throughout.

FIG. 1 shows a longitudinal diagrammatic view of a coil device 1 according to an embodiment. An arrangement of two electrical coil windings 3 which are electrically connected to each other by means of a self-contained circuit 5 is shown. Both the coil windings 3 in this example have a circular cylindrical design and are coaxially arranged so that the magnetic fields generated as a result of a continuous current $I_1$ in circuit 5 may mutually reinforce each other. The coil device can thus be used for the generation of a magnetic field, for example, for applications in magnetic resonance imaging or magnetic resonance spectroscopy. In FIG. 1, the complete closed circuit 5 is formed by a continuous superconducting conductor material, here a coated conductor 17 with a superconducting layer of solid oxide material. The coated conductor 17 has a doubly connected topology and can be produced by slitting an individual strip, the two end regions remaining connected and a closed loop being formed. With an operating temperature of the coated conductor 17 below the transition temperature of the superconducting material, a closed circuit 5 with a continuous superconducting conductor is therefore produced and the total ohmic resistance of this circuit is extremely low. If this circuit is charged with a continuous current $I_1$, this can flow for a long time without appreciable decay enabling a temporally highly constant magnetic field to be generated with the coil device 1.

Both the coil windings 3 and the other parts of the coated conductor 17 connecting these are arranged inside a thermally insulating vacuum container 15, whereby cooling to an operating temperature of the superconductor is facilitated. The superconducting conductor parts can be cooled to a cryogenic operating temperature using a cooling device not shown in more detail here.

To achieve an operational state of the coil device 1, the circuit 5 must be charged with a current. For this purpose, the circuit 5 is connected by means of two power contacts 27 to a feed circuit 29 only indicated diagrammatically here. A feed current $I_2$ is fed into the circuit 5 by means of a power supply 31. A switchable conductor section 7 of the coated conductor 17 is moved to a normally conducting state during supply so that this current $I_2$ does not distribute itself evenly in the two sub-branches between the contacts 27. The second sub-branch of the circuit 5 remains superconductive, on the other hand, so that the feed current through the resistance difference essentially flows via the coil windings 3. After switching the switchable conductor section 7 back to the superconducting state, a closed ring current is produced over the entire closed circuit 5. After this charging process, the connection to the feed circuit 29 can be interrupted.

With the coil device 1, switching between the superconducting state and the normally conducting state of the conductor section 7 takes place as a result of the action of a magnetic field B which is generated by a magnetic device 9. The switchable conductor section 7 is arranged adjacent to the radially external conductor end with regard to the coil windings 3 as this region is relatively freely accessible geometrically. Furthermore, the switchable conductor section is adjacent to one of the endpieces of the slit coated conductor still connected as this connected endpiece is not wound up with it and a freely accessible end region remains here. However, the switchable conductor section is advantageously an already slit section approximately half the width of the original coated conductor material. Switching in the region of such a split conductor branch is advantageous in contrast to the still connected endpiece as the normally conducting state can be achieved more easily with a narrower conductor with lower current carrying capacity. As an alternative to the example shown, the end region of the coated conductor 17 still connected together with areas of its two adjacent slit subconductors can also form the switchable conductor section. The power contacts 27 are then each attached to a conductor branch of the slit coated conductor loop.

The magnetic device 9 is flexibly arranged relative to the conductor section 7. It can be pushed or pulled via an element of motion 25, which is here designed as a piston rod, into the region of the conductor section 7 and/or be retracted and/or pushed away from this region. If the magnetic device 9 is positioned in the immediate vicinity of the conductor section 7, a strong magnetic field B results in the region of the coated conductor, whereby this is moved into a normally conducting state. This state is shown diagrammatically in FIG. 1. With the magnetic device in a retracted position, on the other hand, a considerably lower or even negligible magnetic field is produced at the site of the conductor section 7, and this becomes superconductive again. By means of the element of motion 25 the magnetic device 9 can therefore be moved back and forth along a direction of motion 26. The element of motion 25 is passed through the vacuum container 15 here, enabling the force F required for the movement to act on the outside of the vacuum container. To transfer the movement to the inside of the vacuum container 15, this can be provided with bellows 23 in the region of the element of motion 25 as shown in FIG. 1. However, other embodiments are also conceivable, for example with a piston rod which slides through a vacuum-tight and thermally insulated aperture in the vacuum container 15.

Figure 2:
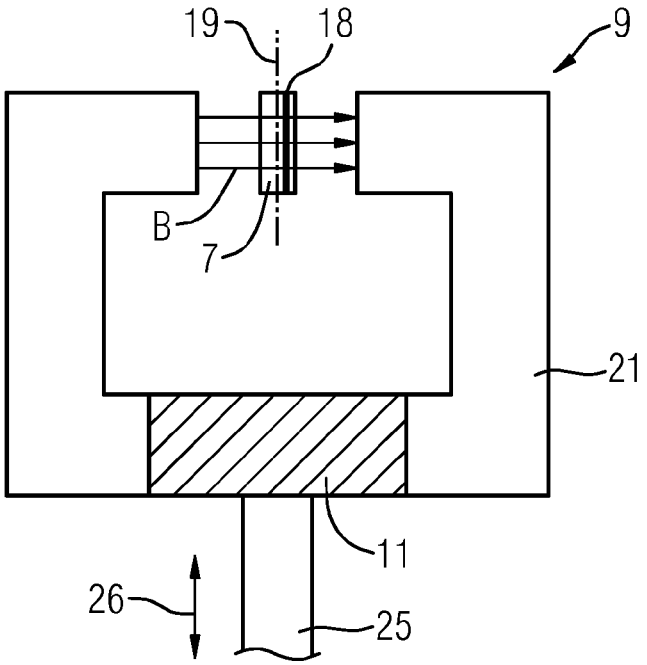
FIG. 2 is a transverse diagrammatic view of the coil device in the region of the magnetic device for a normally conducting state and FIG. 3 is a transverse diagrammatic view, similar to FIG. 2, for a superconducting state.
Figure 3:
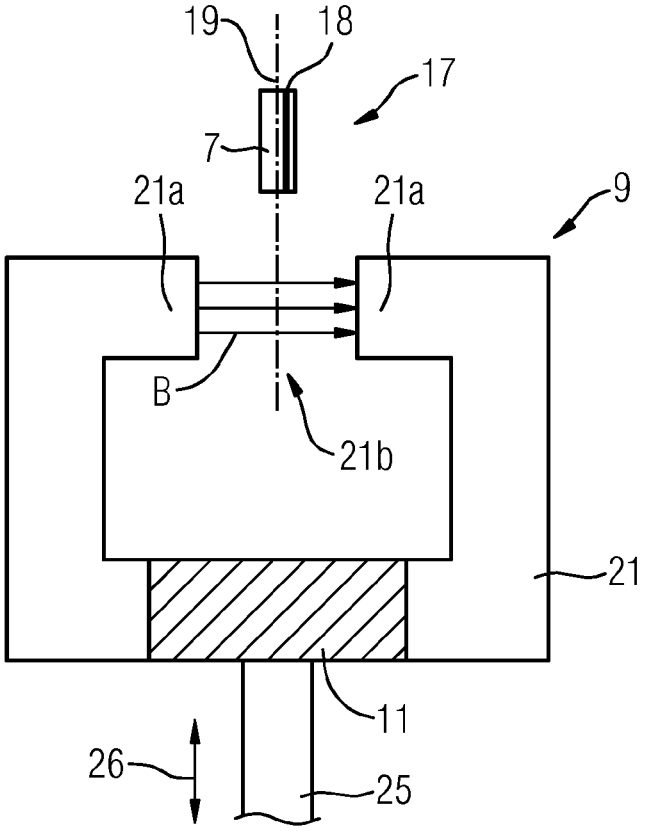

The two states of the switchable region 7 of the coated conductor 17 are shown diagrammatically in FIGS. 2 and 3. FIG. 2 shows a diagrammatic cross-section of the coil device 1 in the region of the magnetic device 9 for a normally conducting state. This cross-section is a view vertical to the image plane of FIG. 1 and along the piston rod 25. The magnetic device 9 was positioned with the element of motion 26 around the switchable region 7 in such a way as to expose the coated conductor to a strong magnetic field B. The magnetic device 9 shown has a strong permanent magnet 11 for this purpose, which is connected to a magnetically soft yoke 21. The yoke 21 is shaped in such a way that the magnetic flow is guided to the location of the switchable region 7 and there forms a magnetic field B that is essentially vertical to the plane 19 of the coated conductor here. As a result of this orientation, a particularly strong influence of the magnetic field on the superconducting properties of the conductor section 7 is achieved. In the example of FIG. 2, the magnetic field B is so strong that the critical magnetic flow density of the superconducting layer 18 of the coated conductor is exceeded and the superconductivity already collapses without an additional current flow. By means of the magnetic field B, a normally conducting state is therefore achieved, and the aforementioned supply of a continuous current is enabled.

Alternatively, however, the magnetic field alone can initially result in a reduction of the critical current density with an ongoing superconducting state of the coated conductor. Through connection to a feed circuit 29 and its external power supply 31, on the one hand the feed current $I_2$ initially distributes itself on the switchable conductor section 7, and on the other hand, the path over the coil windings 3. As a result of the current component flowing over the conductor section 7, the reduced critical current density flowing through the magnetic field B may be exceeded, which in a second step leads to achievement of the normally conducting state of the conductor section 7 and enables the supply of an annularly flowing continuous current to the coil device.

In FIG. 3 a corresponding diagrammatic cross-section for the superconducting state of the coil device 1 of an embodiment is shown. In this state the magnetic device 9 has been retracted over the element of motion 25 so far from the switchable region that only a negligible magnetic field B is generated at the site of the conductor section 7. The embodiment of the magnetic device 9 with a permanent magnet 11 and an adjoining magnetically soft yoke 21 enables a concentration of the magnetic field in the aperture 21*b* between the two arms 21*a* of the yoke. The magnetic device 9 is generally advantageously shaped such that the magnetic flow is largely guided annularly inside the magnetic device 9 and only leaves the magnetic device 9 in one aperture 21*b*, which constitutes a small partial area of the circumference. With direct positioning of the magnetic device 9 over the conductor section 7, a strong magnetic field B thus acts on this while with a laterally displaced arrangement of the magnetic device 9 only a very small magnetic field B acts on the coated conductor. With the laterally displaced arrangement shown in FIG. 3, the disturbance of the electrical properties of the coated conductors 17 is so slight that a continuous superconducting state is achieved and a stable continuous current can flow over the entire circuit 5. The configuration shown in FIG. 3 is therefore an arrangement for continuous operation of the coil, while the arrangement shown in FIG. 2 is only briefly required for charging. As a result of the greater distance of the magnetic device 9 in the superconducting state shown in FIG. 3, with continuous operation of the coil device advantageously only minor heat input is effected into the coated conductor 17 from the magnetic device 9 connected via the element of motion 25 to the external environment. The element of motion may advantageously consist of poorly thermally conductive material, for example of glass-fiber reinforced plastic or stainless steel or at least contain such a material.

In the embodiments shown in FIGS. 1 to 3, the entire magnetic device 9 is flexibly arranged relative to the conductor section 7. In other embodiments, however, only parts of the magnetic device 9 can be moved relative to the conductor section 7. For example, the permanent magnet 11 may be fixed, and only the magnetically soft yoke 21 can be moved such that in a particular position a concentrating flow guide is enabled to the conductor section 7. With a return of the yoke from this selected position, on the one hand the distance between the yoke and the conductor section can be enlarged. On the other hand, the distance between the yoke and the permanent magnet may also be enlarged at the same time which may in turn advantageously result in a reduction in thermal losses during continuous operation of the coil device.

In a further embodiment, the permanent magnet may be moved while the flux guiding yoke or at least part of the yoke remains fixed in the vicinity of the conductor section. In the process, the arms of the yoke may tightly surround the conductor section constantly. An advantage of this embodiment is that the magnetically soft yoke can be positioned particularly closely to the switchable conductor section as no parts in the immediate vicinity of the coated conductor need be moved for switching between the two states.

The various embodiments have been described in detail with particular reference and examples, but it will be understood that variations and modifications can be effected within the spirit and scope of the various embodiments covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A coil device, comprising:

a closed circuit for carrying a continuous current, the closed circuit including at least one superconducting coil winding with superconducting conductor material and a switchable conductor section configured to be switched between a superconducting state and a normally conducting state;

a magnetic device including at least one permanent magnet; and a movement device configured to produce a relative movement between (a) at least a portion of the magnetic device and (b) the switchable conductor section to switch the switchable conductor section between the superconducting state and the normally conducting state.

2. The coil device as claimed in claim 1, wherein the at least one permanent magnet is connected to a magnetically soft yoke configured to guide a magnetic field to the switchable conductor section.

3. The coil device as claimed in claim 1, further comprising:

a vacuum container surrounding the at least one superconducting coil winding and the magnetic device; and wherein the movement device is configured to move at least part of the magnetic device by an external force acting outside of the vacuum container.

4. The coil device as claimed in claim 1, further comprising a vacuum container surrounding the at least one superconducting coil winding and at least part of the magnetic device.

5. The coil device as claimed in claim 1, wherein the closed circuit further includes a superconducting coated conductor.

6. The coil device as claimed in claim 5, wherein the magnetic device includes a directional component substantially perpendicular to a plane of the superconducting coated conductor in a region including the switchable conductor that forms a magnetic field.

7. The coil device as claimed in claim 5, wherein the superconducting coated conductor is a bifurcated coated conductor with a doubly connected topology.

8. The coil device as claimed in claim 1, wherein a continuous superconducting conductor material extends over all of the closed circuit.

9. The coil device as claimed in claim 1, wherein the switchable conductor section adjoins a radially external region of the at least one superconducting coil winding.

10. A method for switching a conductor section of a coil device between a superconducting state and a normally conducting state, the coil device including a closed circuit carrying a continuous current and having at least one electrical coil winding with superconducting conductor material and a conductor section, the method comprising:

operating the coil device with the conductor section in one of the normally conductive state or the superconducting state, wherein operating the coil device comprises using a magnetic device including at least one permanent magnet to generate a magnetic field in a region of the conductor section; and effecting a relative movement between (a) at least a portion of the magnetic device and (b) the conductor section to thereby vary the magnetic field generated by the magnetic device in the region of the conductor section, such that the conductor section switches from the one of the normally conductive state or the superconducting state to the other one of the normally conductive state or the superconducting state.

11. The method as claimed in claim 10, wherein switching of the conductor section is achieved at an operating temperature of between 15 K and 77 K.

12. The method as claimed in claim 10, wherein application of the magnetic field initially results in a reduction of the critical current density in a still superconducting state of the conductor section and subsequently results in feeding of a current from an external feed circuit for to achieve a normally conducting state of the conductor section.

13. The method as claimed in claim 10, wherein effecting a relative movement between (a) the at least a portion of the magnetic device and (b) the conductor section comprises effecting a relative movement between the at least one permanent magnet and the conductor section.

14. The method as claimed in claim 10, wherein:

the at least one permanent magnet is connected to a yoke configured to guide a magnetic field to the switchable conductor section;

effecting a relative movement between (a) the at least a portion of the magnetic device and (b) the conductor section comprises effecting a relative movement between the yoke and both the at least one permanent magnet and the conductor section.

15. The coil device as claimed in claim 1, wherein the movement device is configured to produce a relative movement between the at least one permanent magnet and the switchable conductor section to switch the switchable conductor section between the superconducting state and the normally conducting state.

16. The coil device as claimed in claim 1, wherein:

the at least one permanent magnet is connected to a yoke configured to guide a magnetic field to the switchable conductor section; and the movement device is configured to produce a relative movement between the yoke and both the at least one permanent magnet and the switchable conductor section to switch the switchable conductor section between the superconducting state and the normally conducting state.

17. A magnetic resonance system, comprising:

a device body defining an analysis region configured to receive a sample; and a coil device configured to apply a magnetic field to the analysis region and comprising:

a circuit including at least one superconducting coil winding with superconducting conductor material and a switchable conductor section configured to be switched between a superconducting state and a normally conducting state;

a magnetic device including at least one permanent magnet; and a movement device configured to produce a relative movement between (a) at least a portion of the magnetic device and (b) the switchable conductor section to switch the switchable conductor section between the superconducting state and the normally conducting state.

18. The magnetic resonance system of claim 17, wherein the coil device is configured to produce a relative movement between the at least one permanent magnet and the switchable conductor section.

19. The magnetic resonance system of claim 17, wherein:

the at least one permanent magnet of the coil device is connected to a yoke configured to guide a magnetic field to the switchable conductor section; and the coil device is configured to produce a relative movement between the yoke and the switchable conductor section.

20. The magnetic resonance system of claim 17, wherein the magnetic resonance system is a magnetic resonance imaging system or a magnetic resonance spectroscopy system.

* * * * *